US007784279B2

(12) United States Patent
Shindo

(10) Patent No.: US 7,784,279 B2
(45) Date of Patent: Aug. 31, 2010

(54) STEAM VALVE AND STEAM TURBINE PLANT

(75) Inventor: Osamu Shindo, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 414 days.

(21) Appl. No.: 11/905,821

(22) Filed: Oct. 4, 2007

(65) Prior Publication Data

US 2008/0251140 A1 Oct. 16, 2008

(30) Foreign Application Priority Data

Oct. 18, 2006 (JP) ..... 2006-283752

(51) Int. Cl.
*F01B 31/00* (2006.01)

(52) U.S. Cl. ..... 60/657; 60/660

(58) Field of Classification Search ..... 60/657, 60/660; 123/511, 630.14, 630.15
See application file for complete search history.

(56) References Cited

U.S. PATENT DOCUMENTS 3,286,979 A * 11/1966 Brown et al. ..... 251/118
4,121,617 A * 10/1978 Masek et al. ..... 137/630.14
4,481,776 A * 11/1984 Araki et al. ..... 60/660
5,005,605 A 4/1991 Kueffer et al.

FOREIGN PATENT DOCUMENTS

JP 61-57442 B2 12/1986
JP 62-267504 A 11/1987
JP 2006-046331 A 2/2006

* cited by examiner

*Primary Examiner*—Hoang M Nguyen
(74) *Attorney, Agent, or Firm*—Foley & Lardner LLP

(57) ABSTRACT

A steam valve has: a valve casing; a valve seat; a main valve body slidable to abut to or to detach from the valve seat; a bypass valve body slidably disposed in the main valve body; a cylindrical flow guide surrounding the annular wall of the bypass valve body; and a strainer surrounding the main valve body and the flow guide. The bypass valve body has a steam passage and the annular wall that protrudes out of the main valve body when the bypass valve body is in an open position. The annular wall has steam inlet ports. The flow guide guides steam from outside to flow through a space between the annular wall and the flow guide so as to admit steam into the steam passage in the bypass valve body through whole peripheral part of the annular wall.

6 Claims, 8 Drawing Sheets

STEAM VALVE AND STEAM TURBINE PLANT

CROSS REFERENCE TO RELATED APPLICATION

The present invention contains subject matter related to Japanese Patent Application No. 2006-283752, filed in the Japanese Patent Office on Oct. 18, 2006, the entire content of which is incorporated herein by reference.

BACKGROUND OF THE INVENTION

The present invention relates to a steam valve provided on a steam inlet pipe of a steam turbine for installation in power-station plants and to a steam turbine plant having a steam valve. More particularly, the invention relates to a steam valve constituted by a main steam stop valve having a bypass valve and to a steam turbine plant having such a steam valve.

A steam turbine of the type to be installed in thermal power plants and nuclear power plants is configured as shown in FIG. 5. As FIG. 5 shows, steam generated in the steam generator is supplied to a high-pressure turbine 3 through a main steam stop valve 1 and a governing valve 2. In such a steam turbine, the super high-pressure and super high-temperature steam generated in the steam generator such as a boiler is sectionally supplied to the high-pressure turbine 3 at the start of the steam turbine. At this point, a very large thermal stress develops in any metal component at that part of the turbine 3. The thermal stress deforms the metal component, which may cause cracks and breakage.

In order to suppress such a large thermal stress from developing, so-called full-circumference admission is performed from the start of the steam turbine to the initial loading, thereby warming up the steam turbine, by fully opening the governing valve 2 and controlling the steam flow rate by means of the main steam stop valve 1. This is why the main steam stop valve 1 is configured to control the seam flow rate.

In the example shown in FIG. 5, the steam exhausted from the high pressure turbine 3 is guided to a reheater 31, and then to a medium pressure turbine 33 via a combination reheater valve 32. The rotary shafts of the high pressure turbine 3 and the medium pressure turbine 33 are connected to a power generator 34.

FIG. 6 is a sectional view showing the structure of a main steam stop valve of the conventional type. The main steam stop valve 1 has a valve casing 5 and a valve cover 6, which constitute a pressure vessel and define a valve chamber 4. In the valve casing 5, a baffle plate 7 and a valve seat 8 protrude. The valve chamber 4 contains a strainer 9 and a valve body 10. The valve body 10 is connected to a valve rod 11 and is driven by an oil pressure applied from a hydraulic cylinder 12. Steam S supplied from the steam generator flows through a steam inlet port "I" into the valve chamber 4. The steam "S" passes through the strainer 9 and the valve seat 8 and then flows out from a steam outlet port "O" to the governing valve 2.

FIG. 7 is a sectional view depicting the structure of a valve body of the conventional type. The valve body 10 of the main steam stop valve comprises a cylindrical main valve body 14 and a bypass valve body 15. The bypass valve body 15 can slide in the main valve body 14. An upper end of the bypass valve body 15 projects from the top of the main valve body 14, and a lower end thereof is coupled with the valve rod 11.

An annular wall 16 is formed on that part of the bypass valve body 15, which projects from the top of the main valve body 14. This part of the bypass valve body 15 is closed. A plurality of steam inlet ports 17 are made in the annular wall 16, extend parallel to the direction in which steam flows and lie one above another. The bypass valve body 15 has a steam passage 18 made in the middle part thereof and a steam outlet port 19 made in the lower part thereof. Since the bypass valve body 15 is provided in the main valve body 14, the bypass valve body 15 is configured to adjust the opening of the valve as the valve rod 11 pushes the bypass valve body 15 up against the stream of steam.

As mentioned above, the valve body 10 of the main steam stop valve has the bypass valve body 15 inside the main valve body 14. When the steam turbine is started, the valve body 10 is moved to fully open up the governing valve 2, the main valve body 14 is moved to abut on the valve seat 8 to a fully closed position, and only the bypass valve body 15 is operated to control the steam flow rate. FIG. 7 shows the main valve body 14 of the valve body 10 of the main steam stop valve, which is abutting on the valve seat 8, closing the valve body 10. FIG. 7 also shows the bypass valve body 15 pushed up by the valve rod 11 to the highest position it can take in the main valve body 14. While the bypass valve body 15 remains at the highest position, all steam inlet ports 17 made in the annular wall 16 lie above the top of the main valve body 14, and the bypass valve body 15 is fully opened.

In the main steam stop valve so configured as described above, steam S flows at a considerably high speed into the many steam inlet ports 17 of the bypass valve body 15. The steam S passing through the steam inlet ports 17 made in one side of the bypass valve body 15 and the steam passing through the steam inlet ports 17 made in the other side of the bypass valve body 15 collide with each other in the space defined by the annular wall 16. As a result, the kinetic energy of the steam decreases, and the speed of the steam flow decreases.

Then, the steam at a reduced speed restores the pressure as it passes through the steam passage 18 of the bypass valve body 15. The steam then flows from the main steam stop valve 1 through the steam outlet ports 19 made in the downstream side of the bypass valve body 15. The steam then flows toward the nozzles and vanes of the steam turbine through the governing valve 2 located further downstream side.

The steam flown through the steam inlet ports 17 into the bypass valve body 15 has its kinetic energy reduced and flows at low speed. Therefore, the bypass valve body 15 is not eroded even if it is applied with a trace of drain and oxide contained in the steam.

The bypass valve body 15 described above is called a porous main steam stop valve because it has a plurality of steam inlet ports 17. Such a bypass valve body is disclosed as a structure that prevents damages resulting from erosion, in Japanese Patent Publication No. 61-57442 and Japanese Patent Application Laid-Open Publication No. 2006-46331, the entire contends of which are incorporated herein by reference.

In thermal power plants and nuclear power plants, oxides are formed in the tubes in the steam generators such as boilers and in the steam pipes extending from the steam generators to the steam turbines. At the start of the steam turbines, the oxides contained in the steam flow to the bypass valve body 15 of the main steam stop valve. Particularly, in old plants, oxides are formed in a large amount. The amount of generated oxides increases in concord with the hours the plant has been operated. In other words, the longer the plant has been in service, the larger the amount of oxides formed.

FIG. 8 is a transverse sectional view of the main steam stop valve shown in FIG. 6. As seen from FIG. 8, steam S flowing through the inlet port "I" made in the valve casing 5 flows along the outer circumferential surface of the strainer 9 up to the baffle plate 7 that is opposed to the inlet port I. Since the oxides contained in the influx steam S is heavy, a greater part thereof also flows to the baffle plate 7, by virtue of the inertia of the flow.

Consequently, the oxides pass through the strainer 9, enter inside the strainer 9, and eventually impinge, directly on the outer circumferential surface of the annular wall 16 of the bypass valve body 15. The impingement is prominent, particularly at that part of the annular wall 16 which is indicated by line A in FIG. 8.

As a result, the outer circumferential surface of the annular wall 16 of the bypass valve body 15 is locally eroded with the oxides, at the part indicated by line A in FIG. 8. The steam inlet ports 17 made in this part of the annular wall 16 are deformed. Inevitably, the bypass valve body 15 may fail to perform its function, i.e., the control of the flow rate of steam.

BRIEF SUMMARY OF THE INVENTION

The present invention has been made in view of the foregoing. An object of the invention is to provide a steam valve in which foreign matters are prevented from impinging on a part of the bypass valve body, thereby to achieve an accurate control of the flow rate of steam.

According to an aspect of the present invention, there is provided a steam valve comprising: a valve casing; a valve seat secured to the valve casing; a main valve body axially slidable to abut to or to detach from the valve seat; a bypass valve body axially slidably disposed in the main valve body, the bypass valve body having a steam passage therein and an annular wall that axially protrudes out of the main valve body when the bypass valve body is in a full open position, the annular wall having a plurality of steam inlet ports that are so configured that steam enters the steam passage through the steam inlet ports; a cylindrical flow guide surrounding the annular wall, the flow guide being fixed outside of the main valve body and being configured to guide steam flowing from outside to flow through a space between an outer surface of the annular wall and an inner surface of the flow guide so as to admit steam flow into the steam passage in the bypass valve body through whole peripheral part of the annular wall; and a strainer surrounding the main valve body and the flow guide, the strainer being secured to the valve casing.

According to another aspect of the present invention, there is provided a steam turbine plant comprising: a steam generator; a steam turbine that receives steam generated by the steam generator; the steam valve stipulated above provided between the steam generator and the steam turbine so as to control steam flow supplied to the steam turbine.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAIL DESCRIPTION OF THE INVENTION

First and second embodiments of this invention will be described with reference to the accompanying drawings.

First Embodiment

Figure 1:
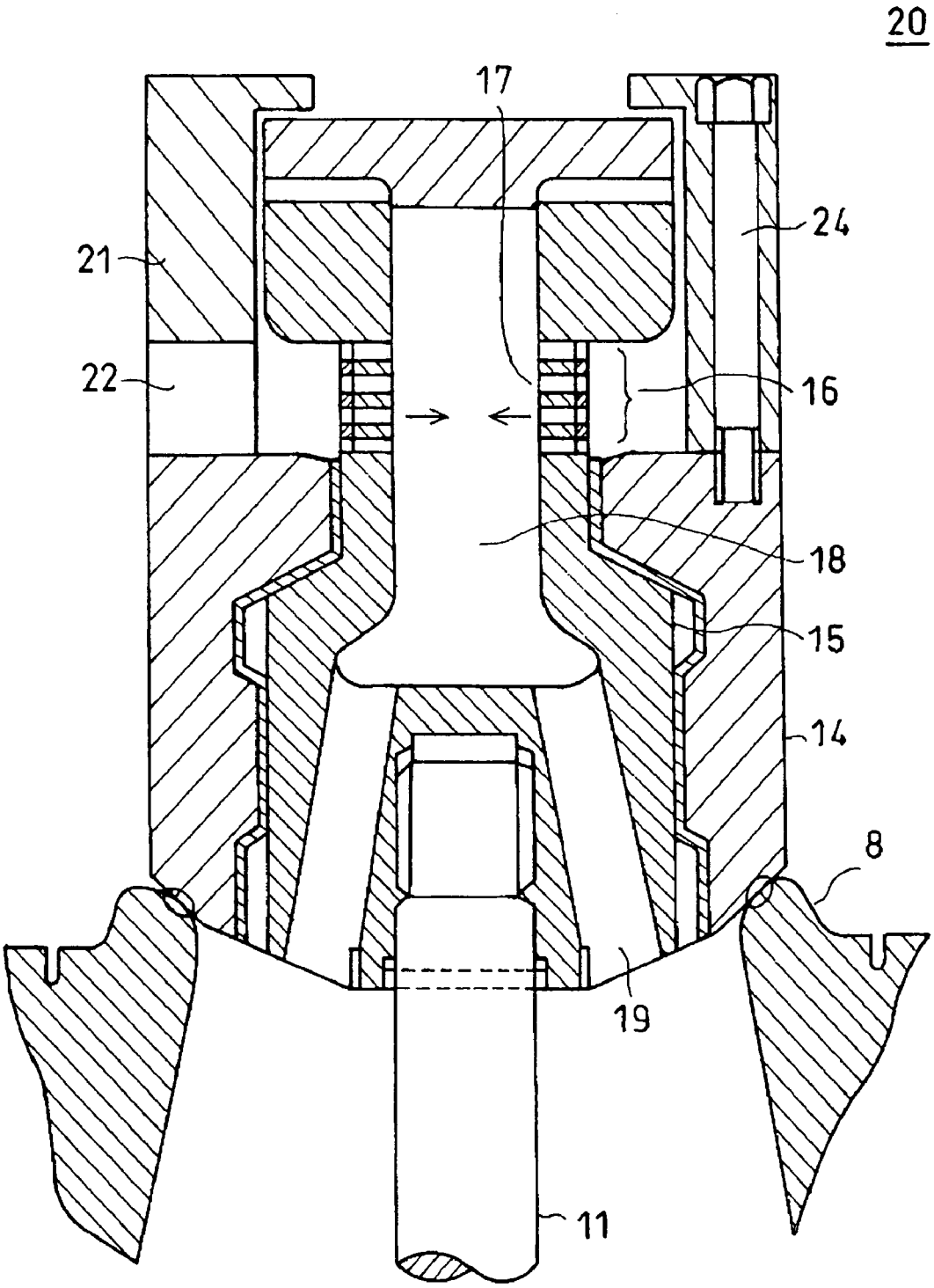
FIG. 1 is a longitudinal sectional view showing a valve body provided in a steam valve according to a first embodiment of the present invention.
Figure 7:
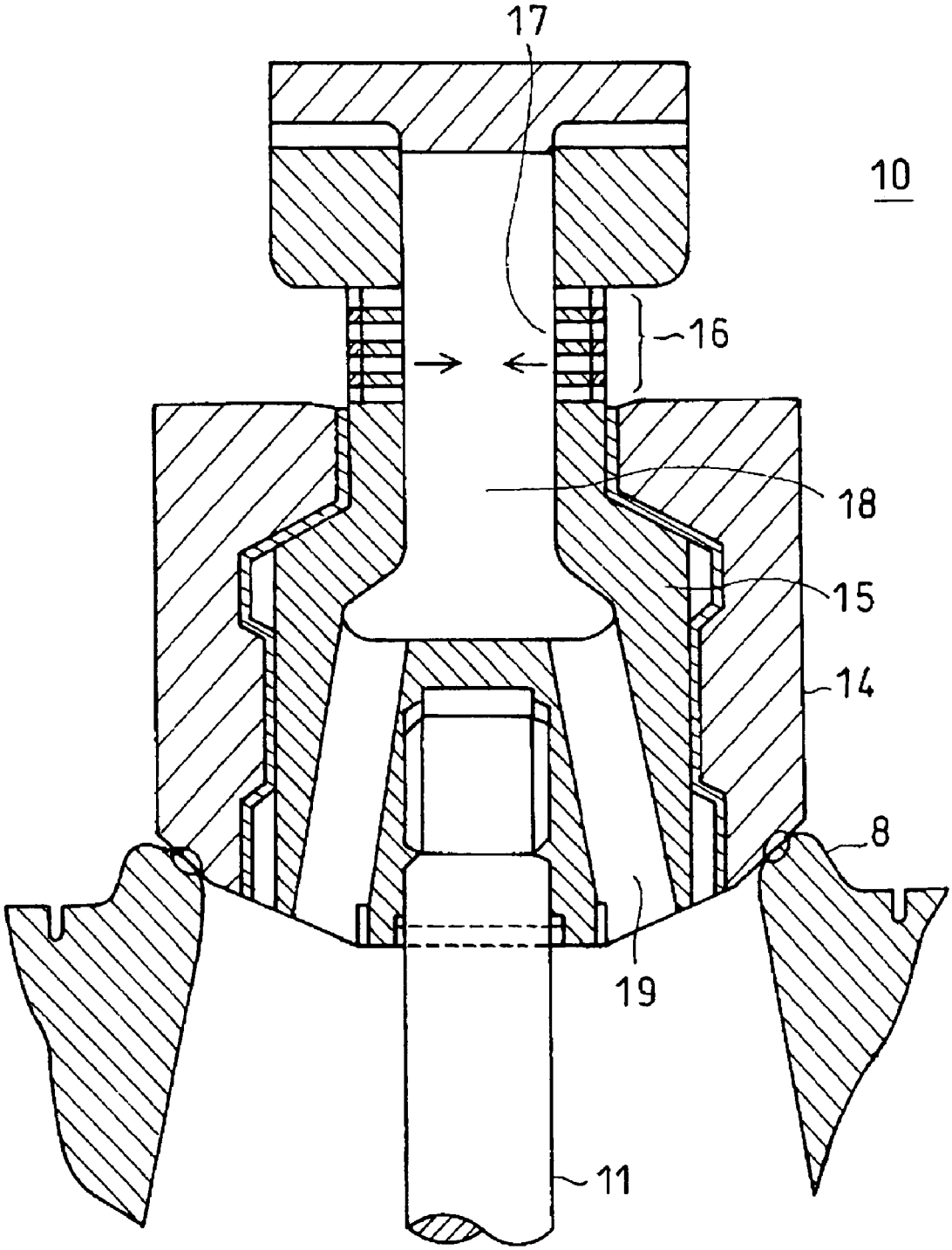
FIG. 7 PRIOR ART
FIG. 7 is a longitudinal sectional view showing a valve body provided in the conventional steam valve.
Figure 8:
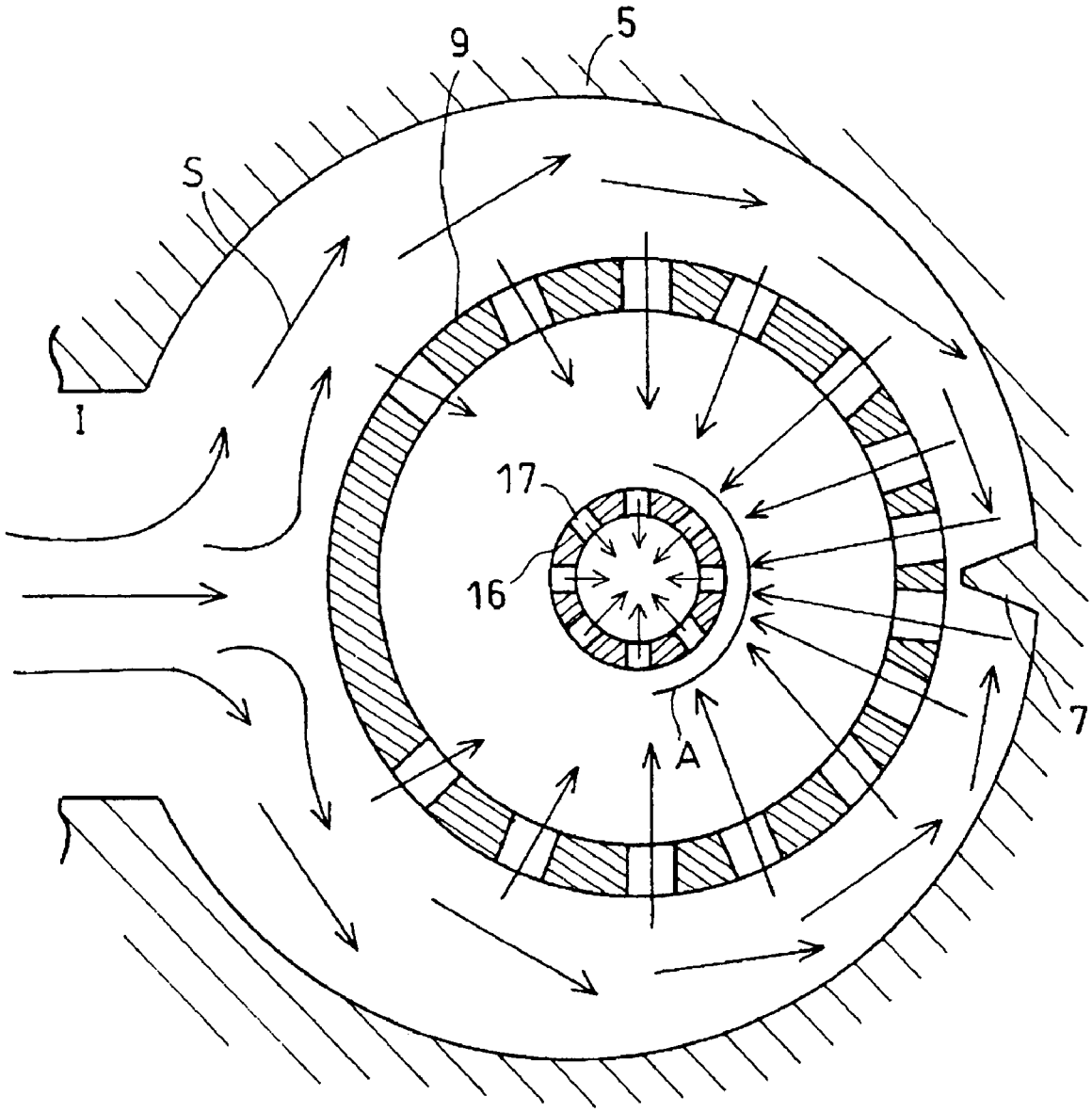
FIG. 8 PRIOR ART
FIG. 8 is a transverse sectional view of the conventional steam valve.

FIG. 1 is a longitudinal sectional view showing the valve body provided in a steam valve according to a first embodiment of the present invention. The components identical to those shown in FIG. 7 illustrating the conventional steam valve are designated by the same reference numerals.

Figure 2:
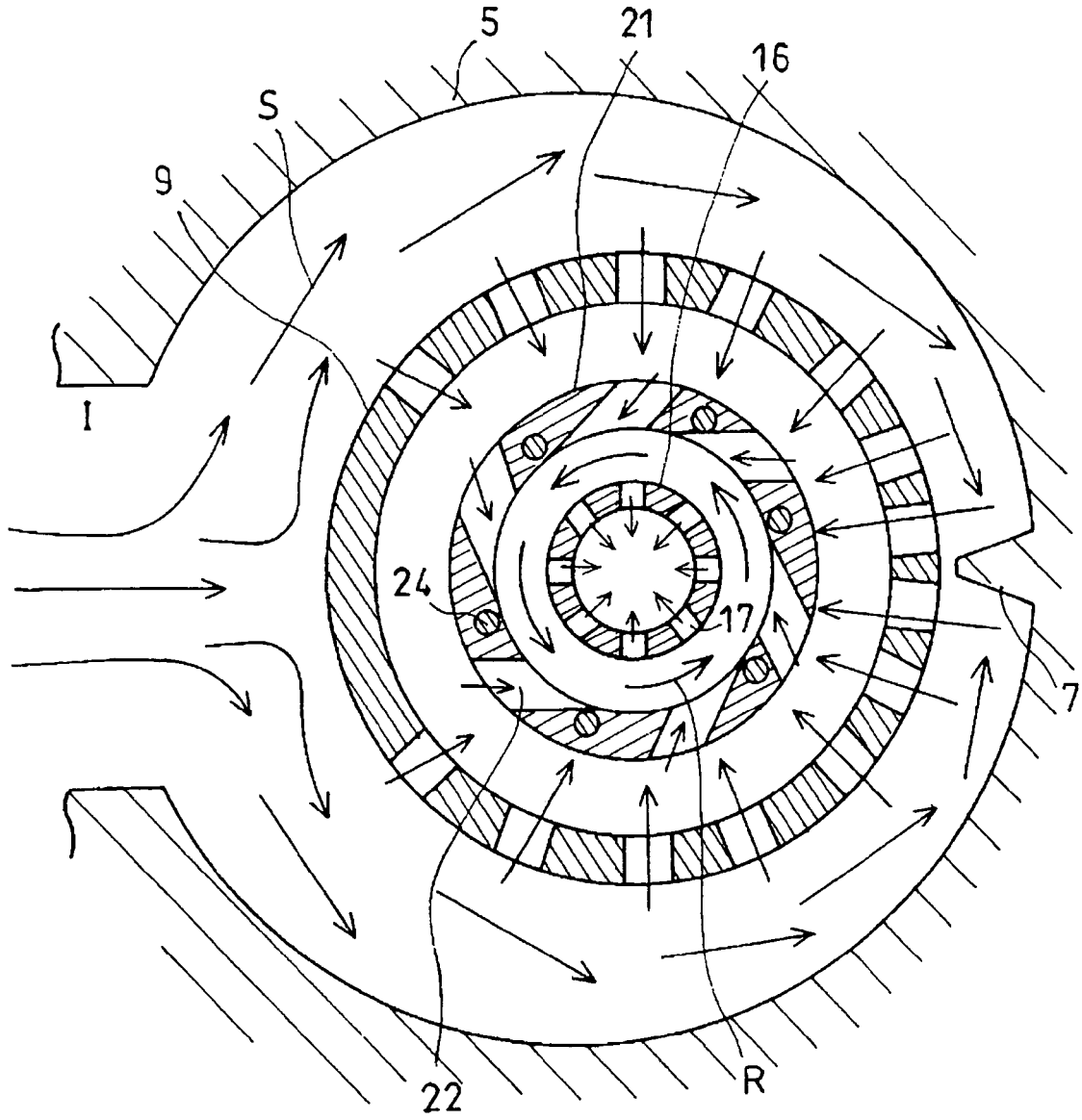
FIG. 2 is a transverse sectional view of the steam valve according to the first embodiment of the invention.

In the present embodiment, a valve body 20 has a flow guide 21 secured to the top of the main valve body 14 by using bolts 24. The flow guide 21 surrounds a bypass valve body 15. A gap is proved between the outer circumferential surface of the head of the bypass valve body 15 and the inner circumferential surface of the flow guide 21. The flow guide 21 has a plurality of steam flow paths 22. The steam flow paths 22 incline to the centerline of the bypass valve body 15 as shown in FIG. 2 that is a sectional view. The angle of inclination is identical to a direction tangential to the outer diameter of the annular wall 16.

In the steam valve according to this embodiment, steam S passing through and flowing into the strainer 9 first collides with the flow guide 21, never directly colliding with the annular wall 16 of the bypass valve body 15. After passing through the steam flow paths 22 of the flow guide 21, the steam S swirls in the space between the outer circumference of the bypass valve body 15 and the inner circumference of the flow guide 21, because the steam flow paths 22 incline at a specific angle. The steam S is therefore flow-regulated and flows uniformly into the bypass valve body 15 from the entire outer circumference of the annular wall 16 of the bypass valve body 15 on which the steam inlet ports 17 are formed. The oxides contained in the steam swirl, too, in the space between the outer circumference of the bypass valve body 15 and the inner circumference of the flow guide 21. The oxides therefore uniformly disperse in the space. As a result, the annular wall 16 of the bypass valve body 15 never undergoes local corrosion in a particular direction.

Figure 3:
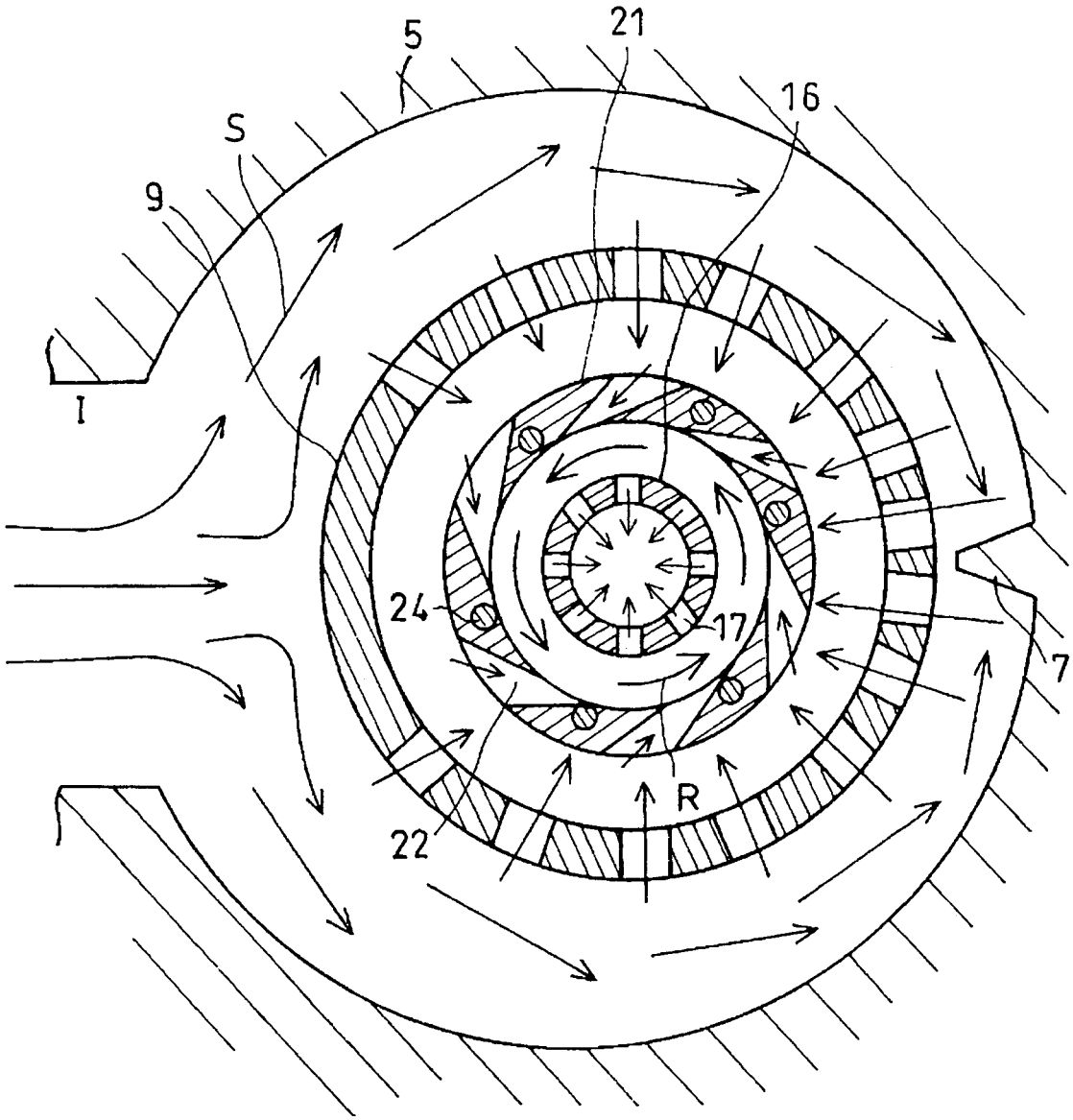
FIG. 3 is a transverse sectional view of a steam valve that is a modification of the first embodiment of this invention.

FIG. 3 shows a modification of the present embodiment. In the modification, cross-sectional areas of the steam flow paths 22 of the flow guide 21 gradually narrow from the outer circumference of the flow guide 21 toward the inner side thereof. At the inner side of the flow guide 21, the steam flow paths 22 have nozzle shapes.

In the modification, the steam flows at high speed as it spouts into the flow guide 21 from the steam flow paths 22. Steam swirl R can therefore be reliably formed in the space between the outer circumference of the bypass valve body 15 and the inner circumference of the flow guide 21.

In the embodiments and the modification thereof, described above, the flow guide 21 has inclining steam flow paths 22, and the steam is thereby made to swirl in the space between the outer circumference of the bypass valve body 15 and the inner circumference of the flow guide 21. However, the present invention is not limited to this configuration. Any other configuration that can prevent foreign matters from locally colliding with the bypass valve may be employed instead. For example, the flow guide 21 may have radially extending steam flow paths 22 so that the steam may not swirl at all.

Second Embodiment

Figure 4:
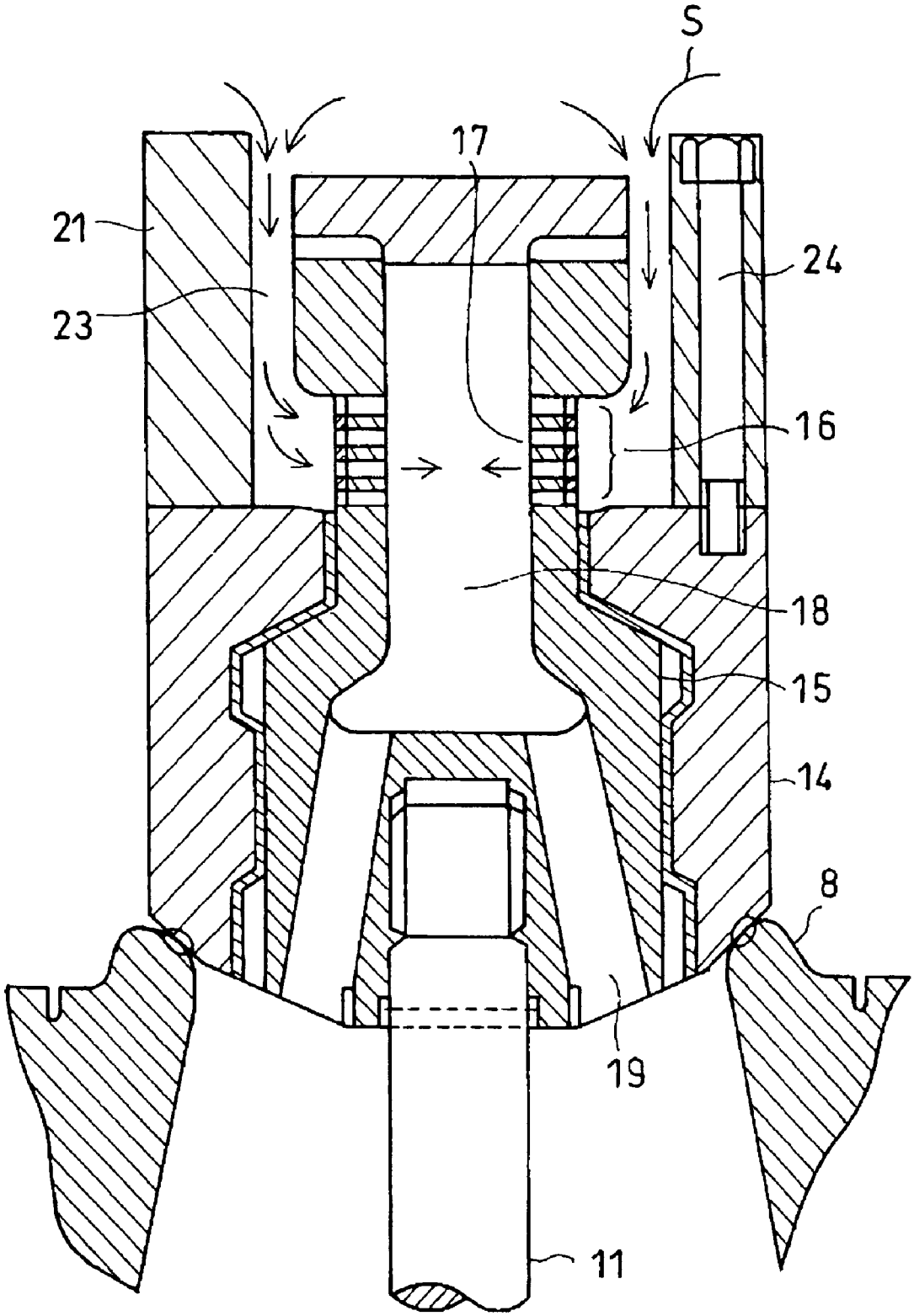
FIG. 4 is a longitudinal sectional view showing a valve body provided in a steam valve according to a second embodiment of the present invention.

A steam valve according to a second embodiment comprises a main valve body 14, a bypass valve body 15, and a flow guide 21, as shown in FIG. 4. The flow guide 21 is secured to the top of the main valve body 14. The flow guide 21 surrounds the head of the bypass valve body 15. A cylindrical steam flow path 23 is provided between the head of the bypass valve body 15 and the flow guide 21.

In the steam valve according to this embodiment, oxides contained in the steam disperse in the steam flow paths 22. Hence, the annular wall 16 of the bypass valve body 15 never undergoes local corrosion. A helical groove may be made in the inner circumferential surface of the flow guide 21 or the outer circumferential surface of the head of the bypass valve body, or in both of them. Then, a swirl of steam is formed at the outer surface of the annular wall 16, achieving an advantage.

Other Embodiment

Figure 5:
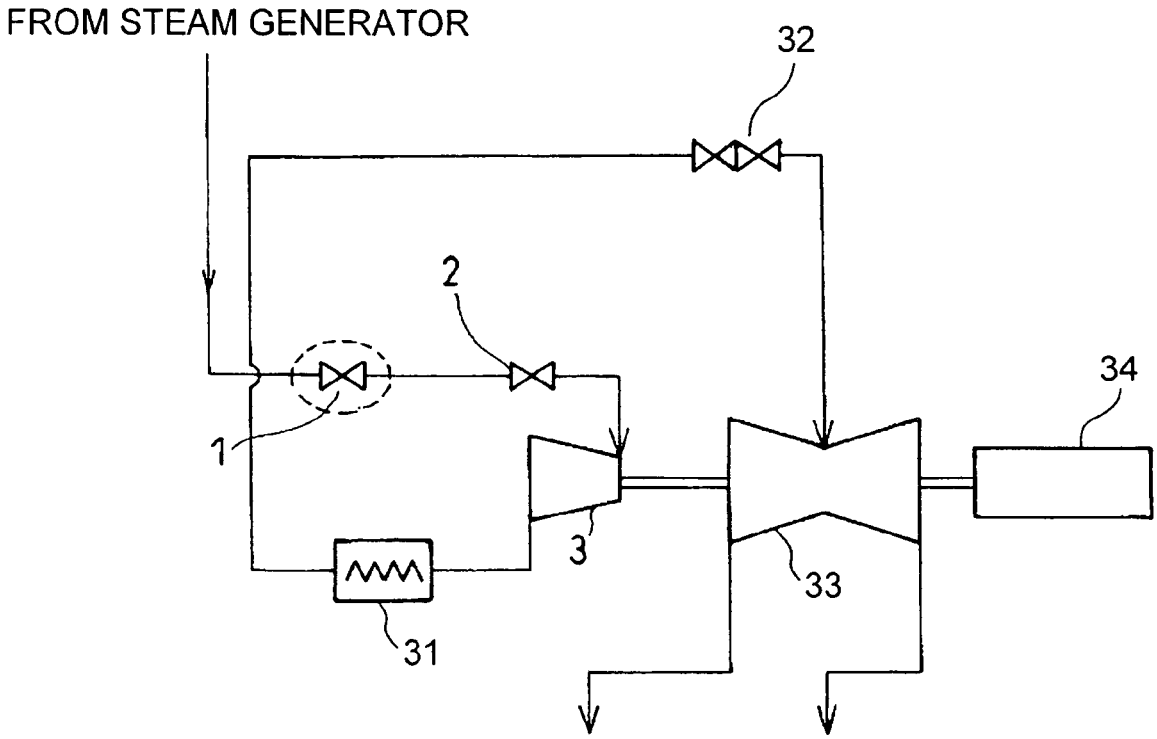
FIG. 5 is a system diagram showing a steam turbine.
Figure 6:
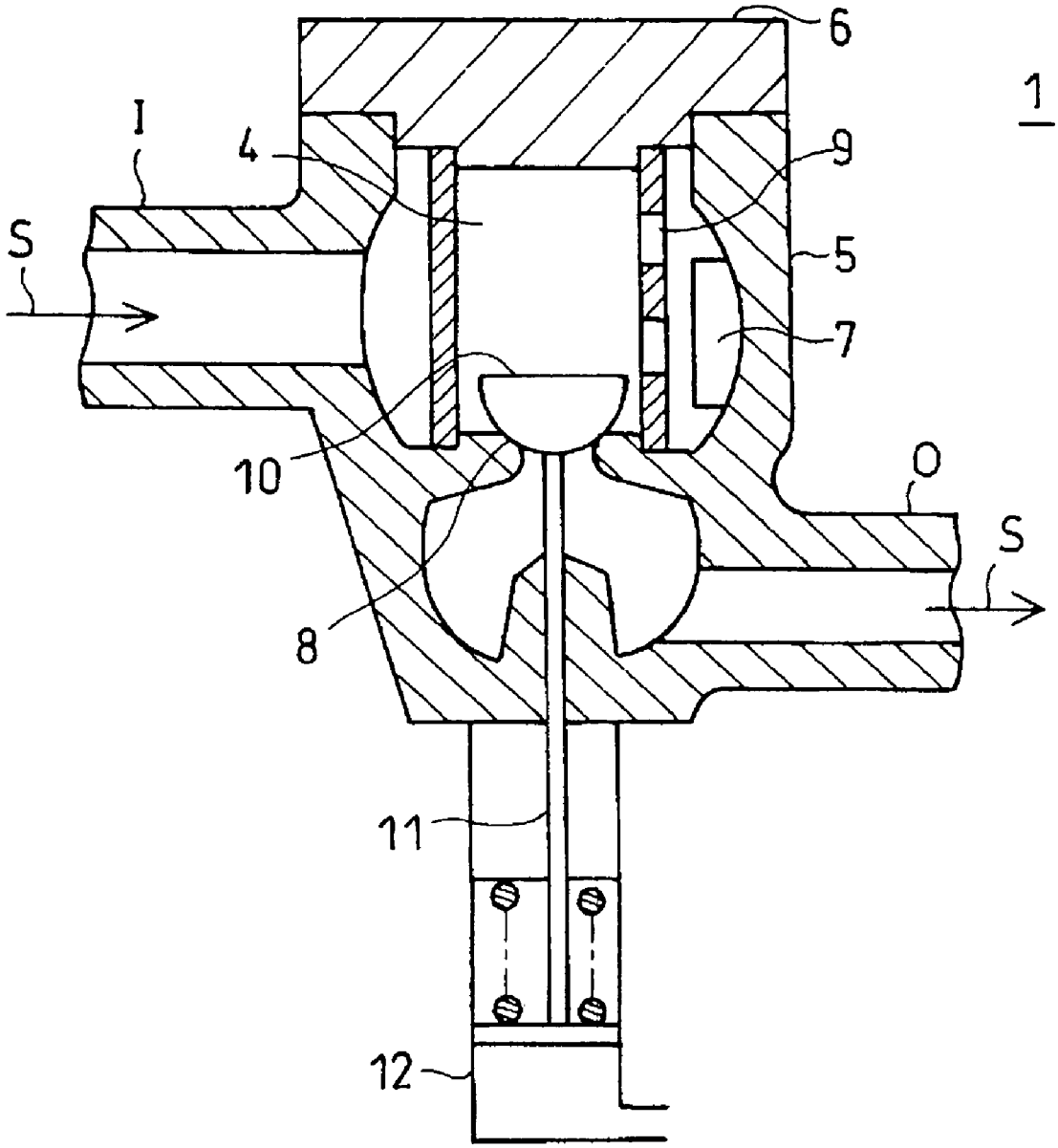
FIG. 6 PRIOR ART
FIG. 6 is a longitudinal sectional view of a conventional steam valve.

The steam valve according to the embodiments mentioned above can be applied to the main stop valve 1 in the steam turbine plant shown in FIG. 5. In that case, the main stop valve 1, which is the steam valve according to the above-mentioned embodiments, is provided between the steam generator and the high-pressure turbine 3 so as to control the steam flow supplied to the steam turbine.

The embodiments of the steam valves in accordance with the present invention explained above are merely examples, and the present invention is not restricted thereto. It is, therefore, to be understood that, within the scope of the appended claims, the present invention can be practiced in a manner other than as specifically described herein.

What is claimed is:

1. A steam valve comprising:

a valve casing;

a valve seat secured to the valve casing;

a main valve body axially slidable to abut to or to detach from the valve seat;

a bypass valve body axially slidably disposed in the main valve body, the bypass valve body having a steam passage therein and an annular wall that axially protrudes out of the main valve body when the bypass valve body is in a full open position, the annular wall having a plurality of steam inlet ports configured such that steam enters the steam passage through the steam inlet ports;

a cylindrical flow guide surrounding the annular wall, the flow guide secured to a top of the main valve body and configured to guide steam flowing from outside of the flow guide to a space positioned between the annular wall and the flow guide; and a strainer surrounding the main valve body and the flow guide, the strainer being secured to the valve casing, wherein a cylindrical wall of the flow guide includes a plurality of steam paths configured to incline toward a peripheral direction of the flow guide so as to generate swirl flow between the flow guide and the annular wall.

2. The steam valve according to claim 1, wherein the steam paths are configured to incline in a tangential direction of the annular wall.

3. The steam valve according to claim 1, wherein a cross-sectional area of the steam paths gradually narrow from an outer side of the flow guide toward an inner side of the flow guide.

4. A steam turbine plant comprising:

a steam generator;

a steam turbine that receives steam generated by the steam generator; and the steam valve according to claim 1 provided between the steam generator and the steam turbine so as to control steam flow supplied to the steam turbine.

5. A steam turbine comprising:

a valve casing;

a valve seat secured to the valve casing;

a main valve body axially slidable to abut to or to detach from the valve seat;

a bypass valve body axially slidably disposed in the main valve body, the bypass valve body having a steam passage therein and an annular wall that axially protrudes out of the main valve body when the bypass valve body is in a full open position, the annular wall having a plurality of steam inlet ports configured such that steam enters the steam passage through the steam inlet ports;

a cylindrical flow guide surrounding a head of the bypass valve body and including a non-porous cylindrical wall, the flow guide secured to a top of the main valve body and configured to admit steam flowing from a top end of the flow guide to a space positioned between the annular wall and the flow guide; and a strainer surrounding the main valve body and the flow guide, the strainer being secured to the valve casing.

6. A steam turbine plant comprising:

a steam generator;

a steam turbine that receives steam generated by the steam generator; and the steam valve according to claim 5 provided between the steam generator and the steam turbine so as to control steam flow supplied to the steam turbine.

* * * * *